United States Patent [19]

Röck et al.

[11] Patent Number: 4,556,205

[45] Date of Patent: Dec. 3, 1985

[54] GAUGING TOOL

[75] Inventors: Erich Röck; Josef Brunner, both of Höchst, Austria

[73] Assignee: Julius Blum Gesellschaft m.b.H., Höchst, Austria

[21] Appl. No.: 474,037

[22] Filed: Mar. 10, 1983

[30] Foreign Application Priority Data

Mar. 24, 1982 [AT] Austria ..... 1144/82

[51] Int. Cl.[4] ..... B25B 3/00

[52] U.S. Cl. ..... 269/2; 33/180 R; 269/37; 269/904

[58] Field of Search ..... 269/1, 2, 37, 904; 33/180 R

[56] References Cited

U.S. PATENT DOCUMENTS 3,327,395 6/1967 Zenke ..... 33/180

*Primary Examiner*—Frederick R. Schmidt
*Assistant Examiner*—Judy J. Hartman
*Attorney, Agent, or Firm*—Wenderoth, Lind & Ponack

[57] ABSTRACT

A gauging tool for use in mounting the rails of a drawer pull-out guide assembly to furniture side walls includes a holding member for supporting the body rail. The body rail can be screwed onto the furniture side wall while held by the holding member of the gauging tool.

5 Claims, 2 Drawing Figures

GAUGING TOOL

FIELD OF THE INVENTION

The invention relates to a gauging tool for mounting rails of drawers to walls of an article of furniture.

SUMMARY OF THE INVENTION

It is the object of the invention to provide a gauging tool which facilitates and expedites the mounting of drawer body rails on furniture side walls and which ensures, in particular, the exact horizontal alignment of the body rail.

According to the invention this is achieved by a gauging plate and a holding member for supporting a rail to be mounted and extending normally to the gauging plate. The holding member is provided with at least one lateral aperture.

The exact alignment of a body rail supported by the holding member is ensured by abutting the gauging plate with the front face of the furniture side wall. Because one or several apertures are provided in the holding member in the region of the fastening screws of the body rail or fastening holes of the body rail, the body rail can easily be screwed to to the furniture side wall while it is held in the gauging tool.

A clamping plate advantageously is formed with the holding member so that the gauging tool can be retained at the furniture side wall by means of a screw clamp, for example, and need not be held manually when actually mounting the body rail, i.e. when drilling fastening holes and inserting fastening screws or fastening dowels.

A further feature is that the clamping plate has a recess receiving a screw clamp. In this way the screw clamp is practically held in the gauging tool, thus facilitating handling of the gauging tool and the screw clamp.

A handle is preferably provided at the gauging plate by means of which the whole gauging tool can be held at the piece of furniture.

To adapt the gauging tool for use with right side as well as with left side body rails advantageously the holding member has oppositely directed holding flanges and holding grooves for the body rails.

A further feature is that the holding member has at least one stop for the depth positioning of the body rail. Such stop may, for example, be formed by a recess receiving the front roller of the body rail.

A further advantageous feature provides that a positioning notch for aiding height positioning is provided in the gauging plate.

Such positioning notch may, for example, correspond to the drawer bottom so that, when mounting the body rail, the distance between the body rail and the drawer bottom need no longer be determined. It is obvious that another reference line could also be used, e.g. the lower edge of the gauging plate. It has provded advantageous to use the drawer bottom as a reference line.

BRIEF DESCRIPTION OF THE DRAWINGS

In the following an embodiment of the invention will be described with reference to the accompanying drawings, wherein.

DESCRIPTION OF THE PREFERRED EMBODIMENT

Figure 1:
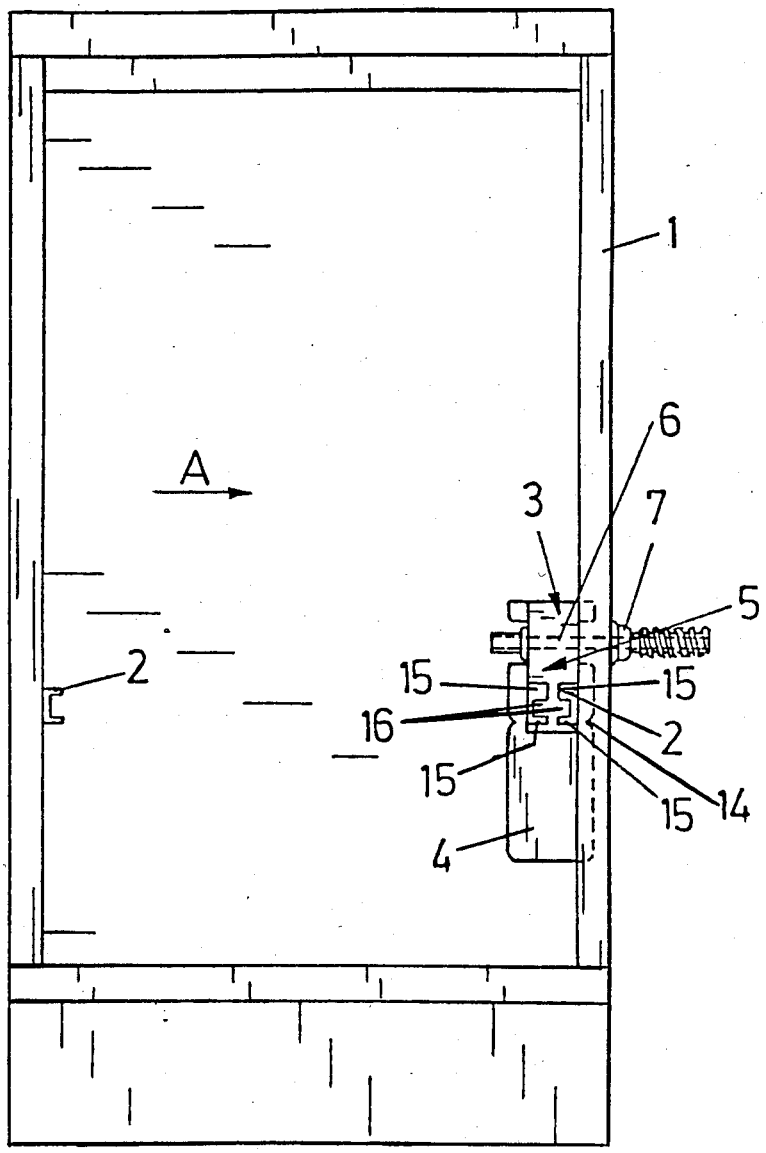
FIG. 1 is a schematic view from the rear of a furniture body, with the rear wall thereof removed, and showing a gauging tool according to the invention in the mounting position on the furniture body.
Figure 2:
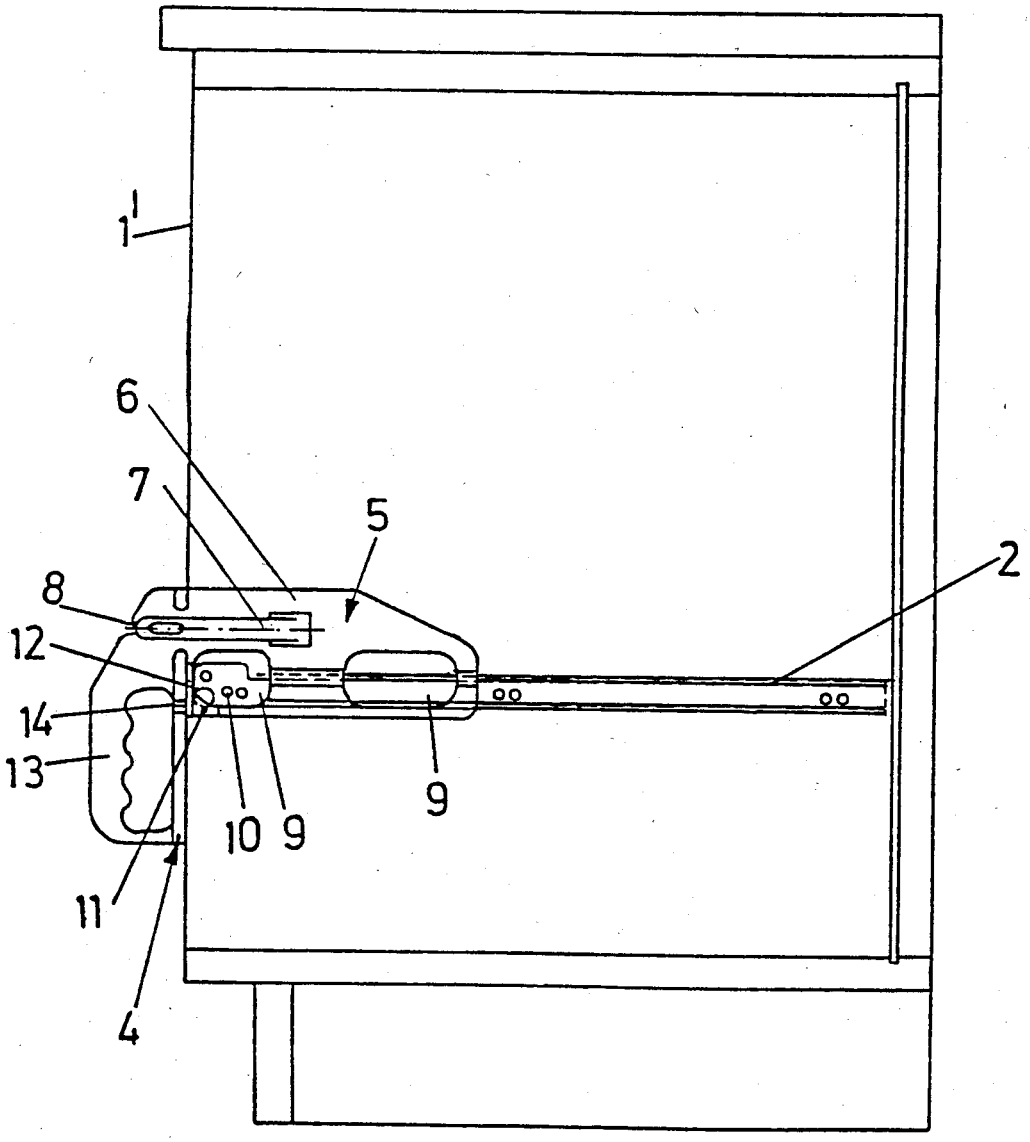
FIG. 2 is a a schematic view from the direction of arrow A of FIG. 1.

In the drawings, furniture side walls are designated by 1, body rails by 2, and a gauging tool by 3.

As can be seen from the drawings, the gauging tool 3 has a gauging plate 4, which rests against the front face 1' of the furniture side wall.

A holding member 5 is arranged normally to the gauging plate 4 and includes a clamping area or portion 6. By means of a screw clamp 7 engaging the clamping portion 6 the gauging plate 4 is held at the furniture side wall 1.

The clamping portion 6 has a recess 8 into which the screw clamp 7 is inserted in order to facilitate handling of the screw clamp 7 and gauging tool 3 and, further, to ensure precise alignment of the gauging tool 3.

The holding member 5 of the gauging tool 3 is provided with apertures 9 arranged in the region of the front fastening screws or dowels 10 of the body rail 2 so that fastening holes can be drilled and fastening screws 10 can be inserted with the body rail 2 being held by the gauging tool 3.

For the depth positioning of the body rail 2 there is provided a stop 11 which in the illustrated embodiment is formed by a recess in which a front roller 12 of the body rail engages in the mounted position.

To facilitate handling of the gauging tool 3, a handle 13 is provided in the area of the gauging plate 4.

The gauging plate 4 further is provided with a positioning notch 14 for positioning the height of the gauging tool 3 and, hence, of the body rail 2.

As can particularly be seen from FIG. 1, the body rail 2 is placed into holding grooves 15 of member 5, and a holding flange 16 is arranged between said holding grooves 15 and extends into the groove between the flanges of the U-shaped configuration of the rail 2.

To make the gauging tool 3 suitable for the mounting of the right as well as of the left body rail, the illustrated embodiment provides that the gauging tool has on opposite sides thereof holding grooves 15 and a holding flange 6.

We claim:

1. A gauging tool for use in mounting generally U-shaped rails of a drawer assembly onto walls of an article of furniture which is to receive a drawer of the assembly, said gauging tool comprising:

a gauging plate having a surface for abutting a front face of a furniture wall;

a holding member integral with said gauging plate and extending normally therefrom in a direction to extend along an inner surface of the furniture well when said surface of said guaging plate abuts the front face of the furniture wall;

said holding member having on opposite lateral sides thereof separate supporting means for supporting a rail to be mounted on the inner surface of the furniture wall, so that said tool may be employed alternately to mount rails on either left side or right side walls of the article of furniture, each said supporting means comprising a pair of vertically spaced grooves adapted to receive flanges of a U-shaped rail and a flange between said grooves for extending between the flanges of the U-shaped rails;

said holding member having therein at least one laterally extending aperture, in the area of said supporting means, such that the rail may be attached to the furniture wall through said aperture; and said holding member having at least one stop means for abutting with a rail supported by said supporting means and thereby for positioning the thus supported rail in the direction of the depth of the furniture wall.

2. A gauging tool as claimed in claim 1, wherein said holding member includes a clamping portion for use in clamping said tool to the furniture wall.

3. A gauging tool as claimed in claim 2, wherein said clamping portion includes a recess adapted to receive a scew clamp.

4. A gauging tool as claimed in claim 1, further comprising a handle integral with said gauging plate.

5. A gauging tool as claimed in claim 1, wherein said gauging plate has therein positioning notch for use in adjusting the position of the rail in the direction of the height of the furniture wall.

* * * * *